US011421502B2

(12) United States Patent
Neacsu et al.

(10) Patent No.: US 11,421,502 B2
(45) **Date of Patent: *Aug. 23, 2022**

(54) WELLHEAD TELESCOPIC ADAPTOR FOR WELLHEAD ASSEMBLY

(71) Applicant: Saudi Arabian Oil Company, Dhahran (SA)

(72) Inventors: Marius Neacsu, Dhahran (SA); Ahmed A. Al-Ramadhan, Dammam (SA); Ahmed Al-Mousa, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

This patent is subject to a terminal disclaimer.

(21) Appl. No.: 17/217,548

(22) Filed: Mar. 30, 2021

(65) Prior Publication Data

US 2021/0215013 A1 Jul. 15, 2021

Related U.S. Application Data

(63) Continuation of application No. 16/677,179, filed on Nov. 7, 2019, now Pat. No. 10,975,654.

(51) Int. Cl.
*E21B 33/04* (2006.01)
*E21B 34/02* (2006.01)

(52) U.S. Cl.
CPC ..... *E21B 33/0415* (2013.01); *E21B 34/02* (2013.01)

(58) Field of Classification Search
CPC .... E21B 33/03; E21B 33/038; E21B 33/0415; E21B 34/02
See application file for complete search history.

(56) References Cited

U.S. PATENT DOCUMENTS

| | | | |
|---|---|---|---|
| 1,896,236 | A | 2/1933 | Howard |
| 1,897,297 | A | 2/1933 | Brown |
| 4,562,888 | A | 1/1986 | Collet |
| 6,688,386 | B2 | 2/2004 | Cornelssen |
| 7,621,324 | B2 | 11/2009 | Atencio |

(Continued)

FOREIGN PATENT DOCUMENTS

WO WO2019132877 7/2019

OTHER PUBLICATIONS

PCT International Search Report and Written in International Appln. No. PCT/US2020/059055, dated Feb. 15, 2021, 15 pages.

*Primary Examiner* — James G Sayre
(74) *Attorney, Agent, or Firm* — Fish & Richardson P.C.

(57) ABSTRACT

A wellhead assembly that includes a wellhead disposed at a surface of a wellbore, a production tree fluidically coupled to the wellhead, and a telescopic adaptor assembly residing between and fluidically coupled to the wellhead and the production tree. The telescopic adaptor assembly extends or retracts to change an elevation of the production tree with respect to the wellhead and rotates to change a radial position of the production tree with respect to the wellhead. The telescopic adaptor assembly includes a flange attached to the wellhead and a first pipe rotationally coupled to the flange. The first pipe is rotational about a longitudinal axis of the first pipe. The telescopic adaptor assembly includes a second pipe attached to the production tree and is disposed concentrically inside the first pipe. The second pipe is movable along the longitudinal axis with respect to the first pipe.

12 Claims, 2 Drawing Sheets

(56) References Cited

U.S. PATENT DOCUMENTS

| | | | | |
|---|---|---|---|---|
| 9,441,441 | B1 | 9/2016 | Hickie | |
| 10,584,546 | B1 | 3/2020 | Ford | |
| 10,975,654 | B1 * | 4/2021 | Neacsu | E21B 33/03 |
| 2007/0114039 | A1 | 5/2007 | Hobdy et al. | |
| 2007/0227722 | A1 * | 10/2007 | Atencio | E21B 37/00 166/53 |
| 2008/0087439 | A1 | 4/2008 | Dallas | |
| 2011/0278021 | A1 | 11/2011 | Travis et al. | |
| 2012/0012335 | A1 | 1/2012 | White et al. | |
| 2015/0096738 | A1 | 4/2015 | Atencio | |
| 2018/0058167 | A1 | 3/2018 | Finol et al. | |

* cited by examiner

WELLHEAD TELESCOPIC ADAPTOR FOR WELLHEAD ASSEMBLY

CROSS-REFERENCE TO RELATED APPLICATIONS

This application is a continuation of U.S. patent application Ser. No. 16/677,179, filed on Nov. 7, 2019, which is hereby incorporated by reference in its entirety.

FIELD OF THE DISCLOSURE

This disclosure relates to wellhead assemblies, and more specifically to adjusting a position of a wellhead assembly.

BACKGROUND OF THE DISCLOSURE

A production tree is an assembly of valves, spools, fittings, and other components used to regulate the flow of fluids in a wellbore. The production tree is positioned above and is fluidically connected to a wellhead. The production tree is connected to surface flow lines. Depending on the position and configuration of the flow line, the production tree or the flow line may need to be modified to align the flow line with a connection interface of the production tree. Such modifications can delay production times.

SUMMARY

Implementations of the present disclosure include a wellhead assembly that includes a wellhead disposed at a surface of a wellbore, a production tree fluidically coupled to the wellhead, and a telescopic adaptor assembly residing between and fluidically coupled to the wellhead and the production tree. The telescopic adaptor assembly is configured to extend or retract to change an elevation of the production tree with respect to the wellhead and is configured to rotate to change a radial position of the production tree with respect to the wellhead. The telescopic adaptor assembly includes a flange attached to the wellhead and a first pipe rotationally coupled to the flange. The first pipe is fluidically coupled to the wellhead and is rotational about a longitudinal axis of the first pipe. The telescopic adaptor assembly also includes a second pipe that includes a first portion disposed concentrically inside the first pipe and a second portion disposed outside the first pipe. The second pipe is movable along the longitudinal axis with respect to the first pipe. The second pipe is rotationally fixed and fluidically coupled to the production tree such that moving the second pipe moves the production tree along the longitudinal axis. The second pipe is rotationally fixed to the first pipe such that rotating the first pipe rotates the production tree about the longitudinal axis of the first pipe.

In some implementations, the wellhead assembly further includes a sealing flange disposed between a coupling end of the second pipe and a distal end of the first pipe opposite a second end rotationally coupled to the flange attached to the wellhead. The sealing flange is rotationally fixed to the first pipe and the second pipe. The sealing flange includes an O-ring configured to form a fluid seal with the first and second pipe to prevent fluid from leaking through the telescopic adaptor.

In some implementations, the wellhead assembly further includes an interior flange extending inwardly from an inner surface of the first pipe. The interior flange is configured to support an end of the second pipe when the second pipe is retracted.

In some implementations, the first pipe includes a coupling flange extending from a rim of the first pipe. The rim is supported on the wellhead. The coupling flange is engaged with the flange attached to the wellhead to allow rotation of the first pipe with respect to the flange attached to the wellhead.

In some implementations, the rim of the first pipe includes an O-ring configured to form a fluid seal with the wellhead to prevent fluid from leaking through a joint between the first pipe and the wellhead.

In some implementations, the wellhead assembly further includes an O-ring disposed between an inner surface of the first pipe and an outer surface of the second pipe to form a fluid seal between the first and second pipe to prevent fluid from leaking through a gap defined between the inner surface of the first pipe and the outer surface of the second pipe.

In some implementations, the second pipe includes a coupling flange extending from a rim of the second pipe. The coupling flange is attached to a flange of the production tree.

In some implementations, the wellhead assembly further includes multiple threaded studs extending through respective holes of the coupling flange and the flange of the production tree to rotationally fix the second pipe to the production tree. The multiple threaded studs extend through respective holes of a second coupling flange extending from a second rim of the first pipe to rotationally fix the second pipe to the first pipe. Moving the second pipe along the longitudinal axis includes turning multiple bolts of the respective threaded studs. The multiple bolts are disposed between the coupling flange of the second pipe and the second coupling flange of the first pipe.

In some implementations, the telescopic adaptor assembly is configured to replace a tubing bonnet.

In some implementations, the flange attached to the wellhead is attached to a top flange of a tubing spool of the wellhead and the second pipe is attached to a bottom flange of a valve of the production tree.

Implementations of the present disclosure also include a wellhead telescopic adaptor assembly that includes a flange attached to a wellhead disposed at a surface of a wellbore. The wellhead telescopic adaptor assembly also includes a first pipe rotationally coupled to the flange. The first pipe is fluidically coupled to the wellhead and is rotational about a longitudinal axis of the first pipe. The wellhead telescopic adaptor assembly also include a second pipe including a first portion disposed concentrically inside the first pipe and a second portion disposed outside the first pipe. The second pipe is movable along the longitudinal axis with respect to the first pipe. The second pipe is fixed and fluidically coupled to a production tree fluidically coupled, through the wellhead telescopic adaptor assembly, to the wellhead. The second pipe is fixed to the production tree such that moving the second pipe moves the production tree along the longitudinal axis. The second pipe is rotationally fixed to the first pipe such that rotating the first pipe rotates the production tree about the longitudinal axis of the first pipe to change a radial position of the production tree with respect to the wellhead.

In some implementations, the wellhead assembly further includes a sealing flange disposed between a coupling end of the second pipe and a distal end of the first pipe opposite a second end rotationally coupled to the flange attached to the wellhead. The sealing flange is rotationally fixed to the first pipe and the second pipe and includes an O-ring configured to form a fluid seal with the first and second pipe to prevent fluid from leaking through the telescopic adaptor.

In some implementations, the wellhead assembly further includes an interior flange extending inwardly from an inner surface of the first pipe. The interior flange is configured to support an end of the second pipe when the second pipe is retracted.

In some implementations, the first pipe includes a coupling flange extending from a rim of the first pipe. The rim is supported on the wellhead. The coupling flange is engaged with the flange attached to the wellhead to allow rotation of the first pipe with respect to the flange attached to the wellhead.

In some implementations, the rim of the first pipe includes an O-ring configured to form a fluid seal with the wellhead to prevent fluid from leaking through a joint between the first pipe and the wellhead.

In some implementations, the wellhead assembly further includes an O-ring disposed between an inner surface of the first pipe and an outer surface of the second pipe to form a fluid seal between the first and second pipe to prevent fluid from leaking through a gap defined between the inner surface of the first pipe and the outer surface of the second pipe.

In some implementations, the second pipe includes a coupling flange extending from a rim of the second pipe and attached to a flange of the production tree.

In some implementations, the wellhead assembly further includes a plurality threaded studs extending through a plurality of respective holes of the coupling flange and the flange of the production tree to rotationally fix the second pipe to the production tree. The plurality of threaded studs extend through respective holes of a second coupling flange extending from a second rim of the first pipe to rotationally fix the second pipe to the first pipe. Moving the second pipe along the longitudinal axis includes turning multiple bolts of the respective threaded studs. The multiple bolts are disposed between the coupling flange of the second pipe and the second coupling flange of the first pipe.

In some implementations, the flange attached to the wellhead is attached to a top flange of a tubing spool of the wellhead and the second pipe is attached to a bottom flange of a valve of the production tree.

Implementations of the present disclosure also include a telescopic adaptor assembly that includes a first flange attached to a first fluid outlet of a first surface. The telescopic adaptor assembly also includes a first pipe rotationally coupled to the first flange. The first pipe is fluidically coupled to the first fluid outlet and is rotational about a longitudinal axis of the first pipe. The telescopic adaptor assembly also includes a second pipe that includes a first portion disposed concentrically inside the first pipe and a second portion disposed outside the first pipe. The second pipe is movable along the longitudinal axis with respect to the first pipe. The second pipe is fixed and fluidically coupled to a second fluid outlet of a second surface. The second fluid outlet is fluidically coupled, through the telescopic adaptor assembly, to the first fluid outlet. The second pipe is fixed to the second fluid outlet such that moving the second pipe moves the second surface along the longitudinal axis with respect to the first surface. The second pipe is rotationally fixed to the first pipe such that rotating the first pipe rotates the second surface about the longitudinal axis of the first pipe with respect to the first surface.

DETAILED DESCRIPTION OF THE DISCLOSURE

The present disclosure describes a telescopic adaptor assembly that is used in place of a fixed tubing bonnet to change a vertical position and a radial position of a production tree. The telescopic adaptor assembly resides between the wellhead and the production tree, with the production tree above the telescopic adaptor assembly. The telescopic adaptor assembly includes a rotatable pipe or sleeve that allows the production tree to rotate and an extendable pipe residing within the rotatable pipe that allows the production tree to move vertically to adjust an elevation of the production tree with respect to the wellhead. Adjusting the elevation and radial position of the production tree allows the production tree to be quickly connected to surface flow lines that might not be aligned with the initial position of the production tree.

Particular implementations of the subject matter described in this specification can be implemented so as to realize one or more of the following advantages. The production tree can be moved vertically with respect to the wellhead without using special tools or equipment (for example, using a wrench), by turning bolts of the telescopic adaptor assembly that support the weight of the production tree. The production tree can be rotated manually, without using special tools. Adjusting the position of the production tree quickly can save time and resources.

Figure 1:
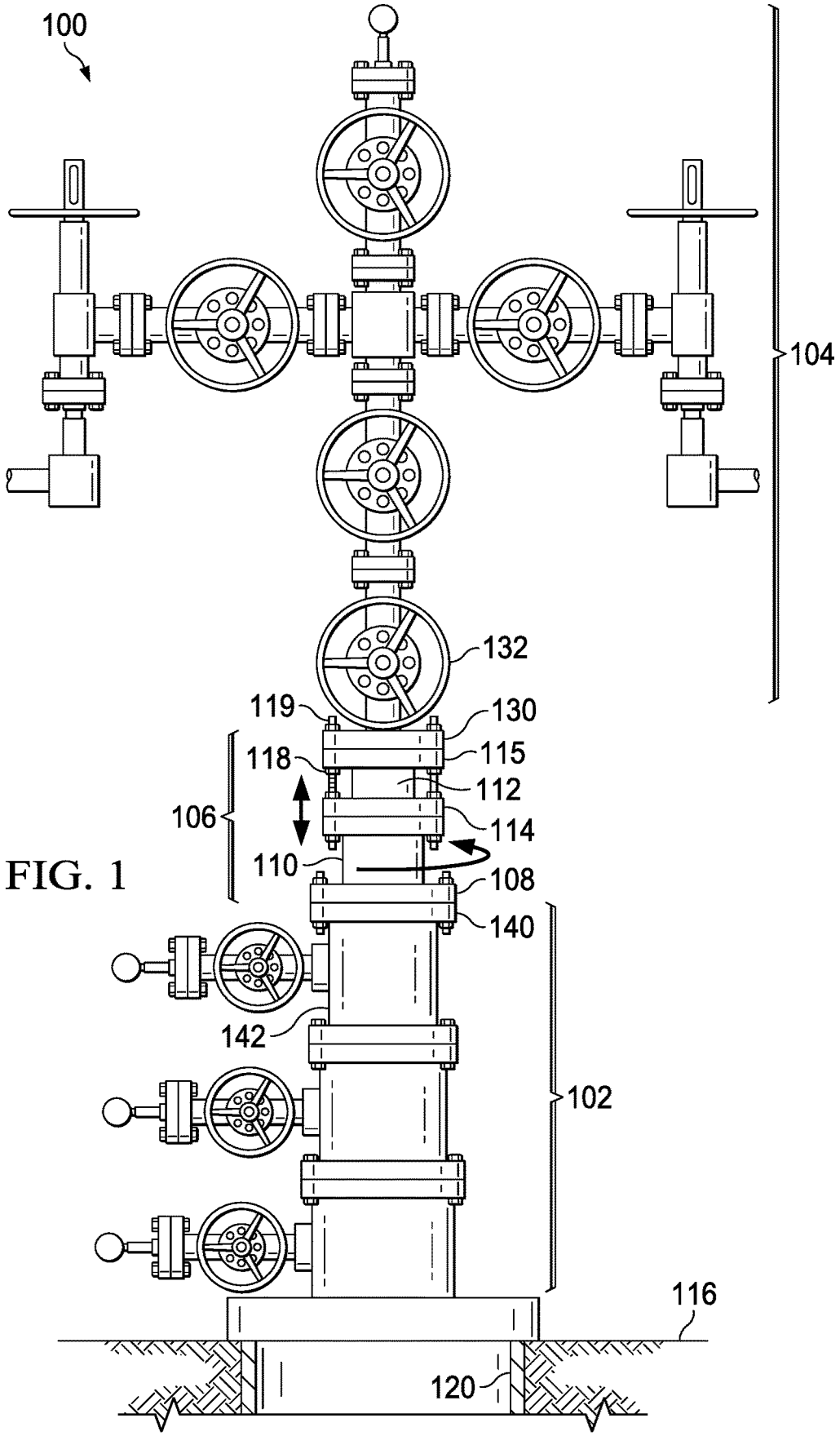
FIG. 1 is a front schematic view of a wellhead assembly.

FIG. 1 illustrates a wellhead assembly 100 at a surface 116 of a wellbore 120. The wellhead assembly 100 includes a wellhead 102, a production tree 104 fluidically coupled to the wellhead 102, and a telescopic adaptor assembly 106 residing between and fluidically coupled to the wellhead 102 and the production tree 104. The telescopic adaptor assembly 106 extends or retracts to change an elevation of the production tree 104 with respect to the wellhead 102 or the surface 116 of the wellbore 120. The telescopic adaptor assembly 106 also rotates to change a radial position of the production tree 104 with respect to the wellhead 102. Adjusting a height or radial position of the production tree 104 allows quick hookup to the production flow line without needing to modifying or retrofitting the production tree 104. Although the telescopic adaptor assembly 106 is shown implemented in an onshore wellhead application, the telescopic adaptor assembly 106 can be used in other applications where adjusting a height or radial position of a piping system is desired, such as in offshore wellhead settings or other piping systems in oil and gas refineries and chemical plants. Additionally, the telescopic adaptor assembly 106 can be used in offshore platform upgrades, in which the wellhead of existing wells needs to be elevated to be compatible with new platform designs.

The telescopic adaptor assembly 106 can replace a fixed tubing bonnet. For example, the telescopic adaptor assembly 106 can function as an adjustable joint and as a tubing bonnet of a wellhead assembly. The telescopic adaptor assembly 106 can be attached, on a bottom end, to a top flange 140 of a tubing spool 142 of the wellhead 102 and can be attached, on a top end, to a bottom flange 130 of a valve 132 (for example, a master valve) of the production tree 104.

The telescopic adaptor assembly 106 has a first pipe 110 and a second pipe 112 with a portion of the second pipe 112 disposed inside the first pipe 110. The first pipe 110 acts as a sleeve disposed around the second pipe 112 to form a fluid seal with the second pipe 112. The first pipe 110 is rotatable (for example, clockwise or counter-clockwise) with respect to the wellhead 102. The second pipe 112 is vertically movable (for example, extendable) with respect to the first pipe 110. The first pipe 110 is attached to the wellhead 102 by a main flange 108 and is attached on the opposite end to a sealing flange 114. The second pipe 112 is attached to a flange 130 of the production tree 104 by a top flange 115. As further described in detail later with respect to FIG. 2, multiple threaded studs 119 extend through respective flanges of the telescopic adaptor assembly 106 to adjust a height of the production tree 104 as bolts 118 of the production tree are turned to move along the threaded studs 119.

Figure 2:
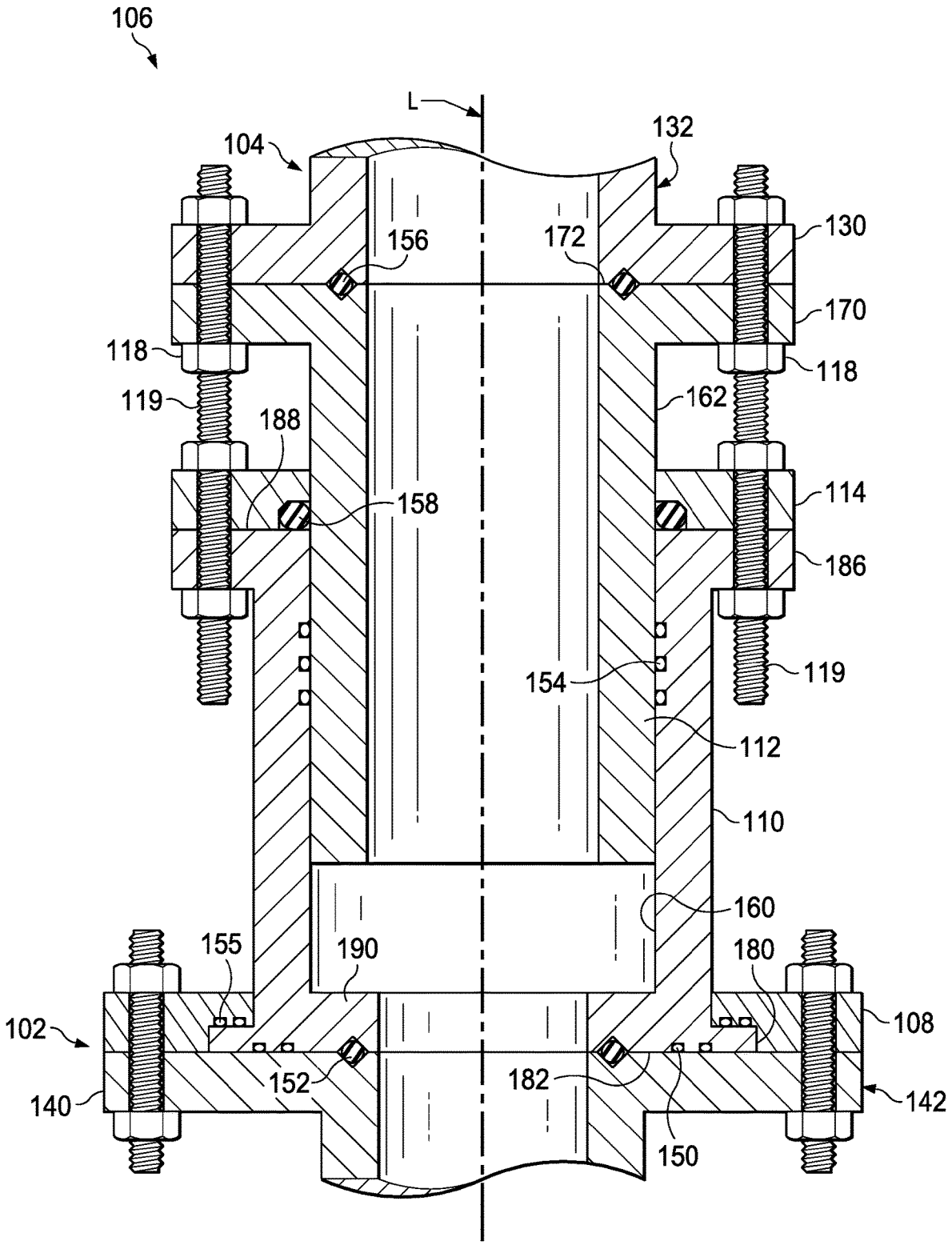
FIG. 2 is a front, cross-sectional view of a telescopic adaptor assembly.

FIG. 2 is a front, cross-sectional view of the telescopic adaptor assembly 106. The telescopic adaptor assembly 106 includes the main flange 108, the first pipe 110, the second pipe 112, and a sealing flange 114. The main flange 108 is attached to the tubing spool 142 of the wellhead 102. The first pipe 110 is rotationally coupled to the main flange 108. For example, the first pipe 110 has a coupling flange 180 extending outwardly from a rim 182 of the first pipe 110. The rim 182 and the coupling flange 180 are supported on the flange 140 of the wellhead 102. The coupling flange 180 is engaged with an annular groove of the main flange 108 to prevent the first pipe 110 from moving vertically and to allow rotation of the first pipe 110 with respect to the main flange 108 that is fixed to the wellhead 102. Thus, the first pipe 110 is fluidically coupled to the wellhead 140 and can rotate about a longitudinal axis 'L' of the first pipe 110.

The first pipe 110 has an interior flange 190 that extends inwardly from an inner surface 160 of the first pipe 110 to support a bottom end of the second pipe 112. The interior flange 190 has an O-ring 152 that forms a fluid seal with the wellhead 102 (for example, with the flange 140 of the tubing spool 142) to prevent fluid from leaking through a joint between the first pipe 110 and the wellhead 102. In some implementations, the rim 182 (or the coupling flange 180) of the first pipe 110 has one or more additional O-rings 150 that form a fluid seal with the wellhead 102. The coupling flange 180 has one or more O-rings 155 that form a fluid seal with the main flange 108 to prevent fluid from leaking through a joint between the coupling flange 180 and the main flange 108.

The second pipe 112 has a first portion (for example, a portion of the tubular body extending from a flange 170) disposed concentrically inside the first pipe 110 and a second portion (for example, the flange 170) disposed outside the first pipe 110. The second pipe 112 is movable along the longitudinal axis 'L' (for example, vertically) with respect to the first pipe 110. The second pipe 112 is rotationally fixed to the first pipe 110. The second pipe 112 is also rotationally fixed and fluidically coupled to the production tree 104 such that moving the second pipe 112 up or down moves the production tree 104 along the longitudinal axis 'L', and rotating the first pipe 110 rotates the second pipe 112 and the production tree 104 about the longitudinal axis 'L' of the first pipe. Specifically, multiple threaded studs 119 long enough to extend from a top flange 186 of the first pipe 110 to the bottom flange 130 of the production tree 104 serve to rotationally fix the production tree 104 and the second pipe 112 to the first pipe 110. Each threaded stud 119 extends through a respective hole of the coupling flange 170 of the second pipe 112 and the flange 130 of the production tree 104 to attach the second pipe 112 to the production tree 104. Each threaded stud also extends through a respective hole of a coupling flange 186 that extends from a rim 188 of the first pipe 110 to rotationally fix the second pipe 112 to the first pipe 110. To move the second pipe 112 (and by extension the production tree 104), the bolts 118 supporting or bearing against the coupling flange 170 of the second pipe 112 (for example, the bolts 118 disposed between the coupling flange 170 of the second pipe 112 and the coupling flange 186 of the first pipe 110) are rotated to extend or retract the second pipe 112, lower or lifting the production tree 104.

The telescopic adaptor assembly 106 also has a sealing flange 114 disposed between a coupling end (for example, the coupling flange 170) of the second pipe 112 and a distal end (for example, the coupling flange 186) of the first pipe 110. The sealing flange 114 is rotationally fixed to the first pipe 110 and the second pipe 112. The sealing flange 114 has an O-ring 158 that forms a fluid seal with the first and second pipe to prevent fluid from leaking through the telescopic adaptor assembly 106. The fluid seal is tightened as the sealing flange 114 is tightened against the coupling flange 186 of the first pipe 110. Another O-ring 156 can be disposed at an interface between the second pipe 112 and the production tree 104 to form a fluid seal.

The telescopic adaptor assembly 106 also has one or more O-rings disposed between the inner surface 160 of the first pipe 110 and an outer surface 162 of the second pipe 112 to form a fluid seal between the first and second pipe to prevent fluid from leaking through a gap defined between the inner surface 160 of the first pipe 110 and the outer surface 162 of the second pipe 112.

The O-rings can be any kind of flexible fitting or gasket that forms a fluid seal between two solid surfaces.

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

What is claimed is:

1. A telescopic adaptor assembly comprising:

a first flange attached to a first fluid outlet of a first surface;

a first pipe rotationally coupled to the first flange, the first pipe fluidically coupled to the first fluid outlet and rotational about a longitudinal axis of the first pipe; and a second pipe slidably coupled to the first pipe and comprising a first portion disposed concentrically inside the first pipe and a second portion disposed outside the first pipe, the second pipe movable along the longitudinal axis with respect to the first pipe, the second pipe fixed and fluidically coupled to a second fluid outlet of a second surface, the second fluid outlet fluidically coupled, through the telescopic adaptor assembly, to the first fluid outlet, the second pipe fixed to the second fluid outlet such that moving the second pipe moves the second surface along the longitudinal axis with respect to the first surface, the second pipe rotationally fixed to the first pipe such that rotating the first pipe rotates the second surface about the longitudinal axis of the first pipe with respect to the first surface.

2. The telescopic adaptor assembly of claim 1, wherein the first pipe is constrained to rotational movement and prevented from moving vertically along the central longitudinal axis with respect to the first fluid outlet.

3. The telescopic adaptor assembly of claim 1, wherein the second pipe is configured to slide along the length of the first pipe to extend or retract with respect to the first pipe such that the second pipe is configured to move along the longitudinal axis with respect to the first pipe without rotation of the second pipe.

4. The telescopic adaptor assembly of claim 1, wherein the first flange comprises a ring fixed to the first surface, the ring disposed about an outwardly projecting shoulder of the first pipe, the ring comprising a corresponding inwardly projecting shoulder configured to engage the outwardly projecting shoulder of the first pipe to allow rotation of the first pipe with respect to the first flange and to prevent vertical movement of the first pipe along the longitudinal axis.

5. The telescopic adaptor assembly of claim 4, further comprising a sealing ring disposed between the inwardly projecting shoulder and the outwardly projecting shoulder to prevent fluid from flowing between the inwardly projecting shoulder and the outwardly projecting shoulder.

6. The telescopic adaptor assembly of claim 1, further comprising a plurality of sealing rings disposed between the first pipe and the second pipe and between the first pipe and the first surface such that the telescopic assembly prevents fluid from leaving the telescopic assembly.

7. The telescopic adaptor assembly of claim 1, wherein the telescopic adaptor assembly is configured to replace a tubing bonnet of a wellhead assembly.

8. The telescopic adaptor assembly of claim 7, wherein the first flange is attached to a tubing spool of the wellhead assembly and wherein the second pipe is attached to a valve of the production tree.

9. A telescopic tubing assembly comprising:

a first pipe configured to be rotatably and fluidically coupled to a first fluid outlet of a first surface, the first pipe constrained against movement away from the first surface along a longitudinal axis of the first pipe with the first pipe coupled to the first fluid outlet of the first surface; and a second pipe slidably coupled to the first pipe and movable along the longitudinal axis with respect to the first pipe, the second pipe configured to be fluidically coupled to a second fluid outlet of a second surface, the telescopic adaptor assembly configured to fluidically couple the first fluid outlet to the second fluid outlet, the second pipe configured to be attached to the second fluid outlet such that, with the second pipe attached to the second fluid outlet, movement of the second pipe along the longitudinal axis moves the second fluid outlet along the longitudinal axis with respect to the first surface, and the second pipe rotationally fixed to the first pipe such that rotating the first pipe rotates the second fluid outlet about the longitudinal axis of the first pipe with respect to the first surface.

10. The telescopic tubing assembly of claim 9, wherein the second pipe is configured to slide along the length of the first pipe to extend or retract with respect to the first pipe such that the second pipe is configured to move along the longitudinal axis with respect to the first pipe without rotation of the second pipe.

11. The telescopic tubing assembly of claim 9, further comprising a first flange disposed about an outwardly projecting flange of the first pipe, the ring comprising a corresponding inwardly projecting shoulder configured to engage the outwardly projecting flange of the first pipe to allow rotation of the first pipe with respect to the first flange and to prevent vertical movement of the first pipe along the longitudinal axis.

12. The telescopic tubing assembly of claim 11, further comprising a sealing ring disposed between the inwardly projecting shoulder and the outwardly projecting flange to prevent fluid from flowing between the inwardly projecting shoulder and the outwardly projecting flange.

* * * * *